US005702090A

United States Patent [19]

Edgman

[11] Patent Number: 5,702,090

[45] Date of Patent: Dec. 30, 1997

[54] SNAP TOGETHER PLASTIC FENCE

[75] Inventor: Thomas J. Edgman, Farmers Branch, Tex.

[73] Assignee: Vinylex Corporation, Knoxville, Tenn.

[21] Appl. No.: 781,523

[22] Filed: Jan. 9, 1997

Related U.S. Application Data

[63] Continuation of Ser. No. 511,728, Aug. 7, 1995, abandoned.

[51] Int. Cl.[6] ..... E04H 17/14

[52] U.S. Cl. ..... 256/19; 256/24; 256/65

[58] Field of Search ..... 256/19, 24, 65, 256/69, 73

[56] References Cited

U.S. PATENT DOCUMENTS

| | | | |
|---|---|---|---|
| 363,557 | 5/1887 | Smith | 256/30 |
| 1,757,077 | 5/1930 | Eiserloh | 256/19 X |
| 3,037,593 | 6/1962 | Webster | 189/34 |
| 3,452,501 | 7/1969 | Zimmer et al. | 52/625 |
| 3,454,262 | 7/1969 | Romano | 256/19 |
| 3,652,060 | 3/1972 | Glover | 256/19 |
| 3,770,245 | 11/1973 | Murdock | 256/24 |
| 3,871,153 | 3/1975 | Birum, Jr. | 52/624 |
| 4,231,552 | 11/1980 | Thomas | 256/24 |
| 4,390,165 | 6/1983 | Murdock | 256/24 |
| 4,722,514 | 2/1988 | Pettit | 256/19 X |
| 4,809,955 | 3/1989 | Veilleux | 256/65 |
| 5,078,367 | 1/1992 | Simpson et al. | 256/24 |
| 5,100,107 | 3/1992 | Latta | 256/73 X |
| 5,161,783 | 11/1992 | German | 256/19 |
| 5,184,441 | 2/1993 | Balfanz, Jr. | 52/241 |
| 5,255,897 | 10/1993 | Pepper | 256/24 |
| 5,285,613 | 2/1994 | Goldsworthy | 52/648.1 |
| 5,480,126 | 1/1996 | Teasdale | 256/24 X |
| 5,496,016 | 3/1996 | Parisien | 256/65 X |
| 5,560,588 | 10/1996 | Hilliard | 256/65 |

*Primary Examiner*—Kenneth J. Dorner
*Assistant Examiner*—Bruce A. Lev
*Attorney, Agent, or Firm*—Akin, Gump, Strauss, Hauer & Feld, L.L.P.

[57] ABSTRACT

A plastic fence assembly, particularly adapted for use as residential privacy fencing and the like, comprises plural post members which are formed of hollow extruded plastic and have opposed side walls and end walls intersected by one or more elongated channels. Elongated spacer elements may be inserted in the channels and retained therein by interlocking projections on the spacer elements and recesses formed in the sidewalls of the post channels. The spacer elements support side edges of vertically extending picket members, brackets for horizontally extending center rail members and to position at least one or both of elongated top and bottom rail members of the fence assembly. The top and bottom rail members have elongated slots formed therein for receiving opposite ends of generally planar boardlike picket members. The top and bottom rail members and the spacer members may be cut to length as may the post and picket members to provide fencing of a desirable height and distance between posts.

9 Claims, 4 Drawing Sheets

SNAP TOGETHER PLASTIC FENCE

This is a continuation of application Ser. No. 08/511,728 filed on Aug. 7, 1995 now abandoned.

FIELD OF THE INVENTION

The present invention pertains to a plastic fence assembly including posts, top and bottom rails, pickets, intermediate mils and spacers or positioning elements which may be easily assembled and fabricated of extruded plastic such as polyvinyl chloride.

BACKGROUND OF THE INVENTION

Many types of fencing are used to restrict entry onto a piece of land, separate one piece of land from another, or provide privacy for persons using a piece of land. For example, so called privacy fencing is widely used to enclose certain portions of a residential lot to provide privacy for the users and to restrict entry. Such fencing should be aesthetically pleasing as well as functional and, historically, wood picket fencing has been widely used. The shortcomings of wood fencing are widely known including decay, termite infestation and the need for frequent maintenance of the wood in order for it to remain attractive.

Efforts have been made to overcome the deficiencies of wood fencing such as providing residential fences having wood posts but utilizing plastic fence panels or pickets. Still further, molded or extruded plastic fencing has been contemplated. However, known types of prefabricated plastic fencing have been indicated to be complicated, difficult to manufacture, difficult to assemble and difficult to replace elements which may become damaged in use. Accordingly, there has been a need for improved fencing formed of plastic, preferably extruded plastic, wherein the fence may be easily assembled and repaired, is of low cost, is aesthetically pleasing and is durable in use. It is to these ends that the present invention has been developed.

SUMMARY OF THE INVENTION

The present invention provides an improved plastic fence assembly including several unique components which may be easily assembled to provide privacy, to restrict access to a particular area, or to separate one area from another.

In accordance with one important aspect of the present invention a snap together fence assembly is provided which includes extruded or molded plastic post members, top and bottom, generally horizontally extending raft members, vertically extending pickets or boards, horizontal intermediate rail members, and a unique spacer and picket receiving member which is adapted to be interposed between the top and bottom rail members and may be easily inserted in and removed from the post members.

In accordance with another important aspect of the present invention a plastic snap together fence assembly is provided having the above mentioned components and further wherein the spacer members may be prefabricated to a predetermined length or cut to length during assembly of the fence. The spacer members provide for positioning the top and bottom rail members as well as intermediate horizontally extending rail members, if used, and also provide a side edge support for the picket or board which is disposed adjacent to the fence post.

In accordance with a further aspect of the present invention a unique plastic fence assembly is provided having end posts, corner posts and intermediate posts which are of the same general shape and appearance and which are adapted to support the fence rail members and pickets or boards in one or more generally longitudinal extending channels formed in the posts, respectively. The posts each include channels which are adapted to receive a unique spacer member for at least partially supporting a picket or board adjacent to the post and for at least positioning the bottom rail member.

In accordance with yet another aspect of the present invention, a unique connection is provided for a plastic fence post and a spacer or support member for supporting elongated generally horizontally extending top and bottom rails of the fence assembly as well as a side edge of a picket or board adjacent to a post.

The present invention provides a functional, aesthetically pleasing and easy to assemble fence assembly which includes the advantages mentioned above as well as other features and important aspects which will be further appreciated by those skilled in the art upon reading the detailed description which follows in conjunction with the drawing.

DESCRIPTION OF THE PREFERRED EMBODIMENTS

Figure 1:
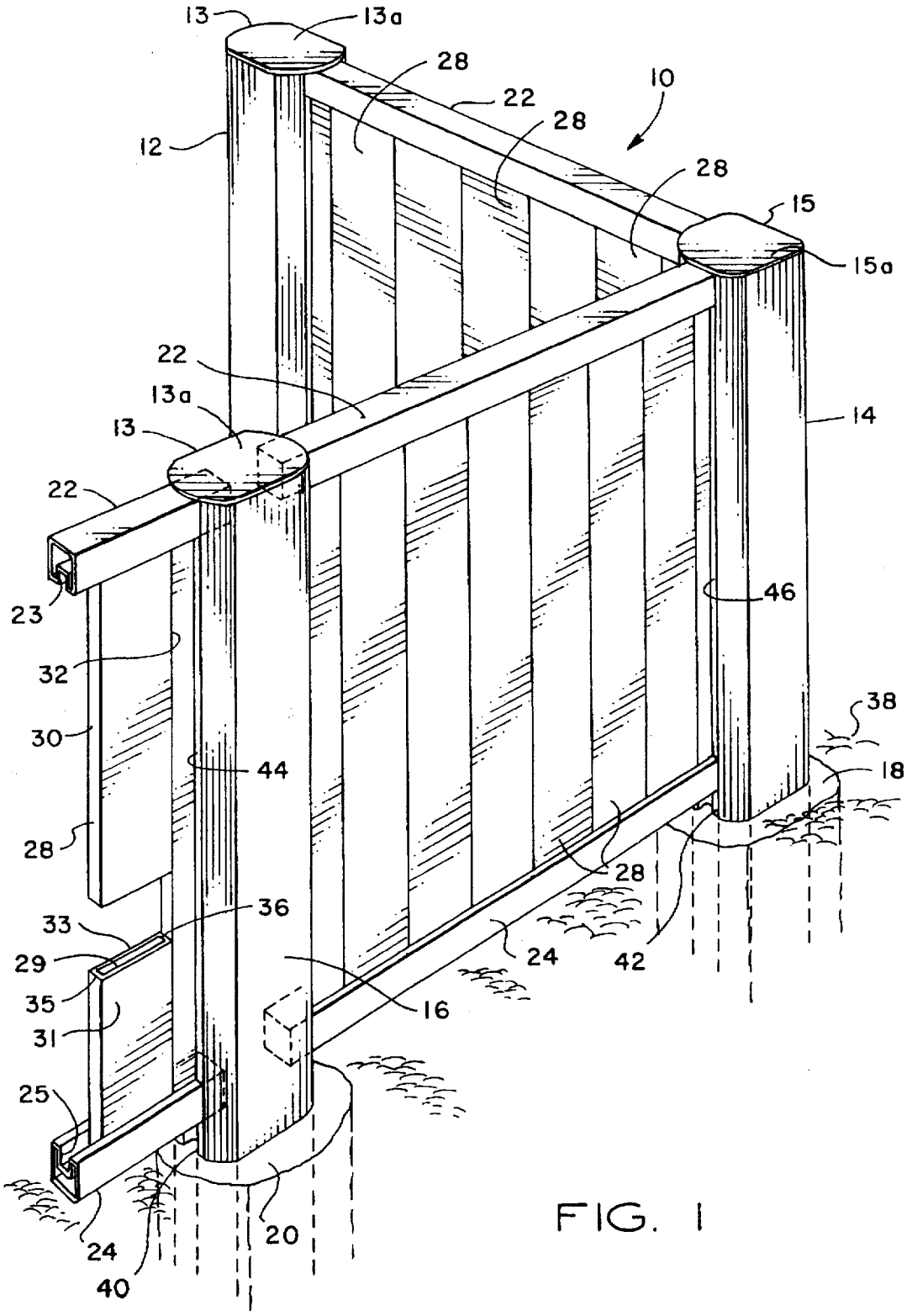
FIG. 1 is a perspective view of the fence assembly of the present invention.

In the description which follows like elements are marked throughout the specification and drawing with the same reference numerals, respectively. The drawing figures are not necessarily to scale.

The present invention contemplates the provision of a fence assembly which may be assembled and selectively configured to the erector's wishes and is preferably formed of a polymer material such as a styrenic resin or a vinyl based resin, including lightweight outdoor grade rigid polyvinyl chloride. The components of the fence may be formed by extrusion or molding or, in certain cases, fabricated from bar or plate stock. It is contemplated that substantially all of the components can be fabricated by extrusion.

Figure 6:
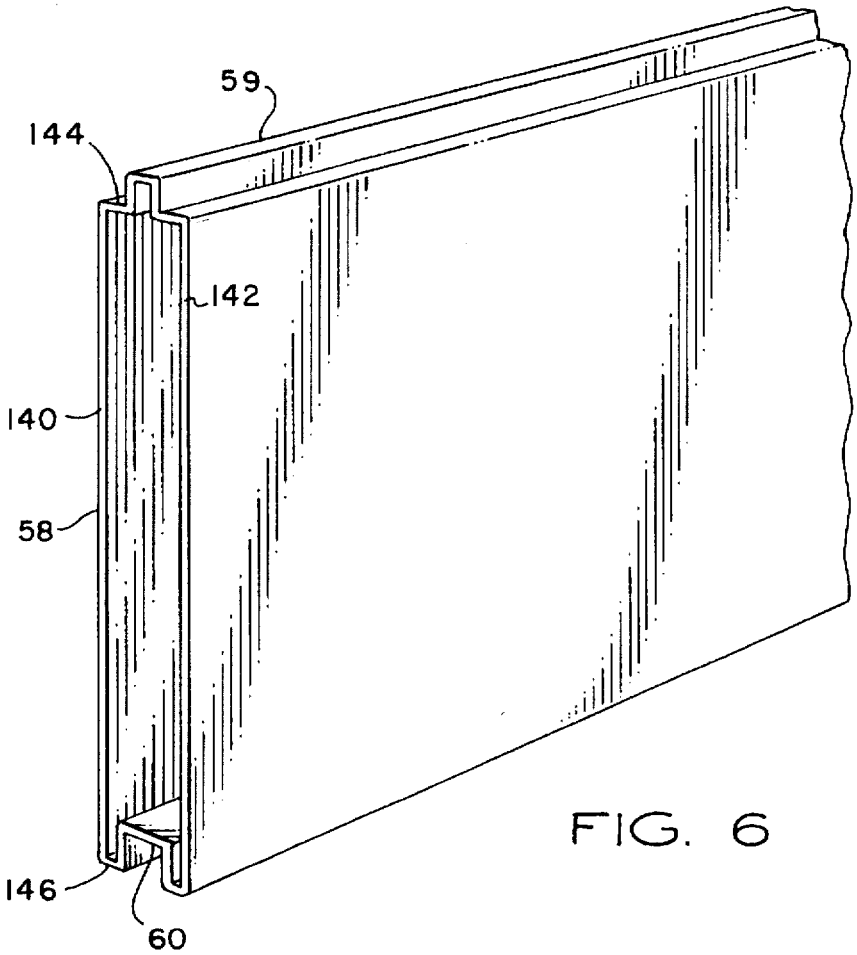
FIG. 6 is a perspective view of a portion of a tongue and groove picket or board for the fence of the present invention.

Referring to FIG. 1 there is shown a portion of a fence assembly in accordance with the invention and generally designated by the numeral 10. The fence assembly 10 includes an end post 12, a corner post 14 and an intermediate post 16. Each of the posts 12, 14 and 16 may be formed as hollow extrusions and will be described in further detail hereinbelow. The posts 12, 14 and 16 may be embedded in suitable support means in the earth such as concrete filled post holes 18 and 20, as shown by way of example for supporting the posts 14 and 16. The fence assembly 10 is also made up of spaced apart top and bottom rail members 22 and 24 which may be of selected length dependent on the spacing between the posts of the fence assembly. The rail members 22 and 24 may be of identical configuration and are adapted to support therebetween elongated pickets 28. The pickets 28 are characterized as substantially flat elongated platelike members which, in the embodiment shown in FIG. 1, have generally flat opposed transverse edges 30 and 32. An alternate embodiment of a picket for the fence assembly 10 is illustrated in FIG. 6 and will be described hereinbelow. As shown in FIG. 1 the pickets 28 have a hollow interior core or space 29 defined by longitudinal side walls 31 and 33 and transverse end walls 35 and 36. The pickets 28 may be open at opposite ends, not shown.

As shown in FIG. 1, the top and bottom rails 22 and 24 may be of identical configuration and include elongated slots 23 and 25 for receiving opposite ends of the pickets 28, respectively. The slots 23 and 25 are dimensioned to have a width slightly greater than the thickness of the pickets 28. As shown in FIG. 1, the posts 12, 14 and 16 are also each provided with a decorative weathertight end cap designated by the numerals 13 and 15. The end caps 13 and 15 have cap portions 13*a* and 15*a*, respectively, corresponding to the general cross sectional shapes of the respective posts 12, 14 and 16. The end cap 13 is further illustrated in FIGS. 2 and 8 and will be described further herein.

It is often desirable in fence construction to place the bottom rail or the lower edge of fencing at least a short distance above the ground surface 38 for purposes of grooming turf or cleaning away debris adjacent to or under the fence when the fence is erected over hard surfaces. FIG. 1 illustrates the bottom rail 24 disposed above the ground surface 38 and positioned in accordance with unique spacer members 40 and 42 which are disposed in cooperating channels, not shown in FIG. 1, formed in the posts 14 and 16, for example. Respective spacer members 44 and 46 are also disposed in the aforementioned channels between the rails 22 and 24 and may serve to position the top rail with respect to the bottom rail, during assembly of the fence, spaced apart substantially the distance between the opposed top and bottom edges of the pickets 28, taking into consideration the depth of the slots 23 and 25 in the rail members. Moreover, the spacer members 44 and 46 also support the side edges of the pickets 28 which are adjacent the respective posts.

Figure 2:
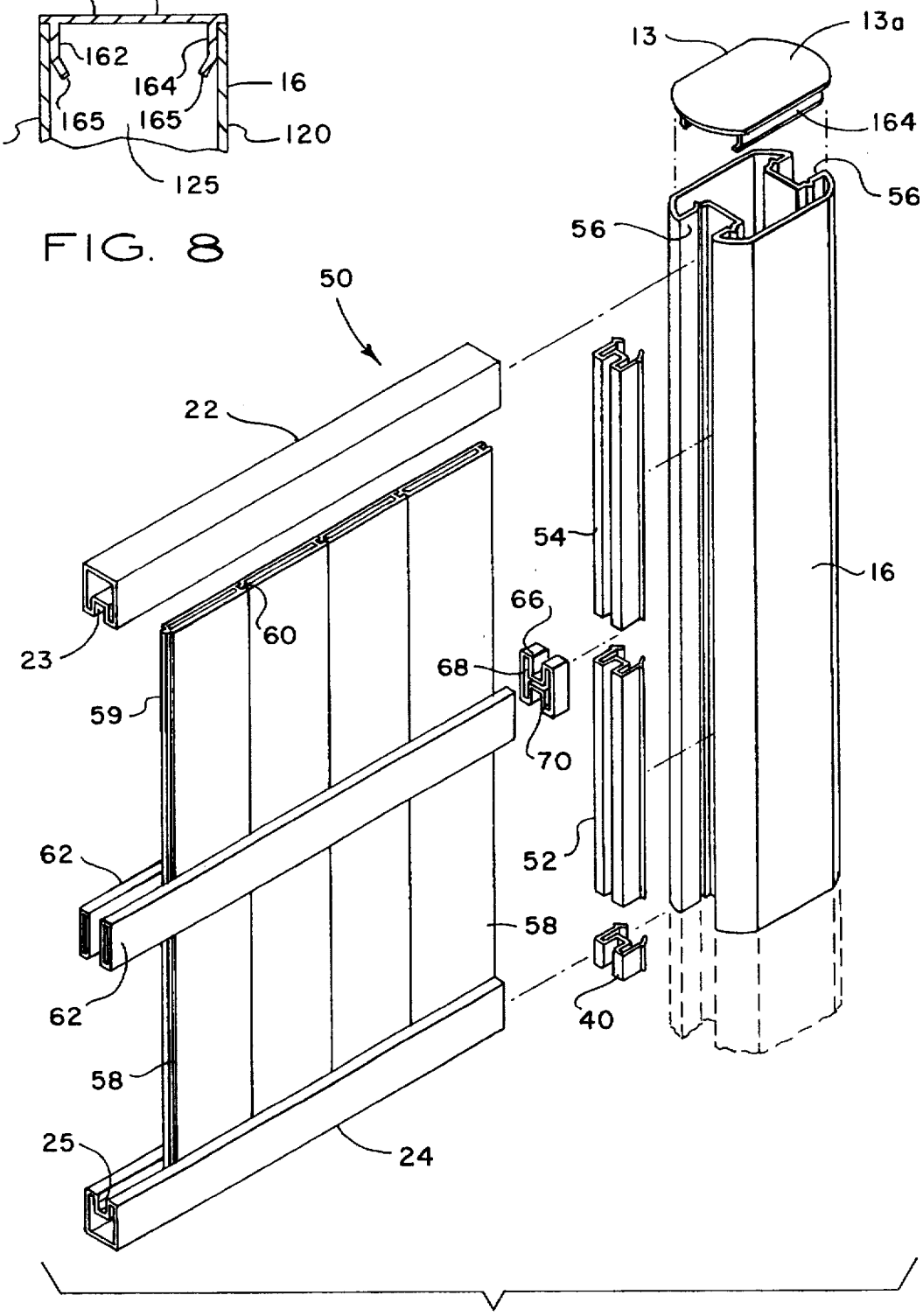
FIG. 2 is an exploded perspective view showing several of the components of the fence assembly.

Referring now to FIG. 2 there is illustrated an exploded view of a portion of a fence assembly similar to the fence assembly 10 and utilizing several common components, but being generally designated by the numeral 50. The fence assembly 50 utilizes, for example, one or more posts 16, one shown, the top and bottom rails 22 and 24 and spacer members 40, 52 and 54 which are of the same cross sectional configuration and fit into one of two opposed elongated channels 56 formed in the post 16 and extending longitudinally the length thereof. Only that portion of the post 16 which would be above the ground surface is illustrated by the solid lines in FIG. 2.

The fence assembly 50 also includes a set of pickets 58 which are characterized as elongated, flat, rectangular platelike members similar to the pickets 28 but of a tongue and groove configuration. An elongated longitudinal projection or tongue 59 is formed on one side and a cooperating groove 60 formed on the other side of each of the pickets 58. The pickets 58 are of the same thickness as the pickets 28 to facilitate entry into the slots 23 and 25 of the respective rail members 22 and 24. The fence assembly 50 also includes elongated, generally flat, rectangular center rail members 62 which are shown disposed on opposite sides of the pickets 58 and are adapted to extend between adjacent posts of the fence assembly 50. Opposite ends of the center rail 62 extend into cooperating slots 68 and 70 formed in a support bracket 66, one shown. The center rail support bracket 66 is adapted to be disposed in the channel 56 between the spacer members 52 and 54. The center rail members 62 provide support for particularly long pickets 58 to minimize deflection of the pickets between the rail members 22 and 24 and to provide a decorative modification to the fence assembly 50. The center rail members 62 are also preferably formed as hollow core extrusions, thus having a cross sectional configuration similar to the pickets 28.

When the fence assembly 50 is assembled to connect the members shown in the exploded view to the post 16 the spacer members 40, 52 and 54 are snapped into the channel 56 to set the distance between the ground surface and the bottom side of the bottom rail 24, and to position the support bracket 66 for the center rail members 62.

Figure 3:
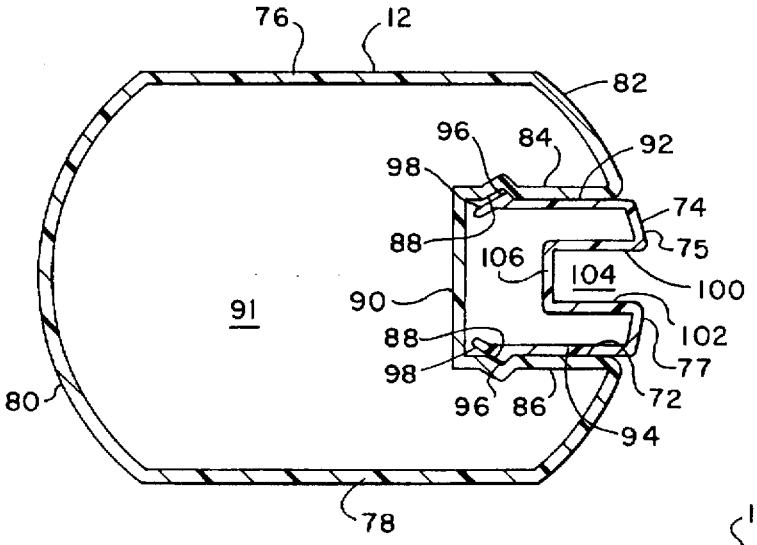
FIG. 3 is a transverse section view of an end post showing one embodiment of a spacer snapped into the channel formed in the post.

Referring now to FIG. 3 there is shown a transverse section view of the end post 12 which has an elongated channel 72 formed therein identical in configuration to the channels 56 for the post 16. A section of spacer member, generally designated by the numeral 74, is shown disposed in the channel 72 in locking engagement therewith. The post 12 is formed to have a perimeter wall defined by opposed, flat sidewalls 76 and 78 and arcuate end walls 80 and 82 the latter being intercepted by the channel 72. The channel 72 is defined by opposed, generally parallel, spaced apart sidewalls 84 and 86, each having a longitudinal somewhat V shaped recess 88 formed therein, as shown. A transverse bottom wall 90 interconnects the channel sidewalls 84 and 86. The nominal wall thickness of the post 12 may be on the order of about 0.125 inches, and the above-defined perimeter wall encloses an interior space 91.

The spacer member 74, which is exemplary of all of the spacer members described hereinbefore, is characterized by opposed, generally parallel elongated tines 92 and 94 which have opposed, outwardly facing projections 96 formed thereon and adjacent to distal sloping surfaces 98 which aid in inserting the tines of 92 and 94 into the channel 72 so that the projections 96 may engage the channel sidewalls defining the recesses 88 to lock the spacer member in the channel 72. The spacer member 74 is further defined by generally arcuate surfaces 75 and 77 which interconnect the opposed tines 92 and 94 with sidewalls 100 and 102, respectively, and defining a slot 104. A transverse bottom wall 106 interconnects the slot sidewalls 100 and 102. As previously mentioned the slot 104 in the spacer member 74, is of a width just slightly greater than the thickness of the pickets 28 or 58. The spacer member 74, as well as the spacer members 40, 42, 44, 46, 52 and 54, are of essentially the same configuration, have a nominal wall thickness of about 0.080 inches and are preferably formed of rigid extruded polyvinyl chloride (PVC) of an outdoor grade.

Figure 4:
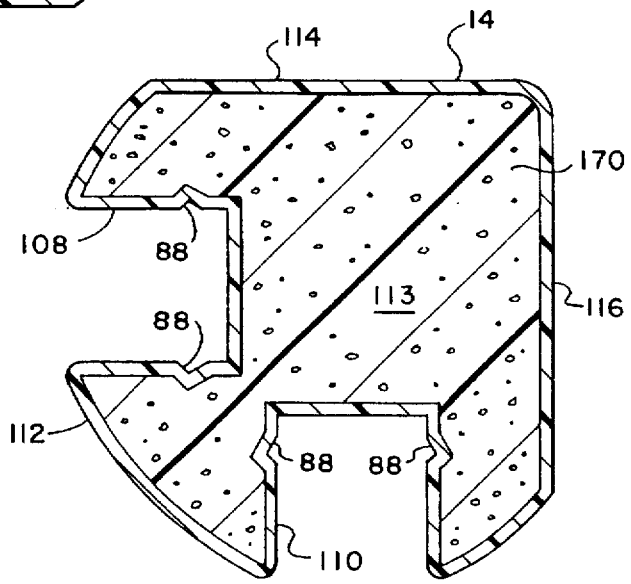
FIG. 4 is a transverse section view of a comer post of the fence assembly shown in FIG. 1.

Referring briefly to FIG. 4 the comer post 14 is shown in transverse cross section and is provided with respective channels 108 and 110 which intersect an arcuate wall 112. The channels 108 and 110 are of the same configuration as the channels 56 and 72. For example, the channels 108 and 110 each include elongated opposed somewhat V shaped recesses 88 formed in opposed sidewalls defining the respective channels. The arcuate outer wall 112 is connected at its opposite sides to generally planar sidewalls 114 and 116 to define a perimeter wall enclosing an interior space 113. The nominal wall thickness of the post 14 is preferably the same as for the post 12.

Figure 5:
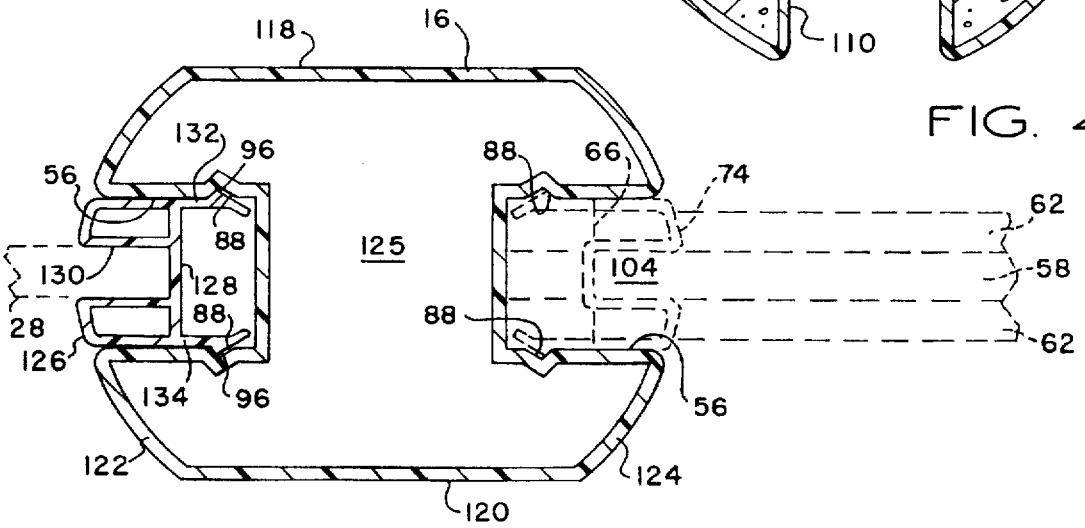
FIG. 5 is a transverse section view of an intermediate post including an alternate embodiment of a spacer disposed in a receiving channel in the post.

Referring further to FIG. 5, the post 16 is illustrated in transverse section view and includes a perimeter wall defined by opposed generally flat planar sidewalls 118 and 120 which interconnect arcuate end walls 122 and 124, respectively, forming an interior space 125. The end walls 122 and 124 are intersected by the opposed, back to back channels 56, each having the opposed V shaped recesses 88 formed therein, as illustrated.

FIG. 5 also shows a modified embodiment of the spacer member, generally designated the bottom wall 26. The spacer 126 has a web 128 which forms the bottom wall of a slot 130 for receiving the side edge of a picket such as the picket 28 shown. The only difference between the spacer 126 and the spacer 74 resides in the provision of the web 128 which extends between opposed tines 132 and 134. Accordingly, the effective length of the tines 132 and 134 is less than the tines 92 and 94 and the stiffness of the tines 132 and 134 may be greater as regards the projections 96 and their ability to deflect during insertion of the spacer into the channel 56. The greater stiffness of the tines 132 and 134 may, however, require greater effort to remove the spacer 126 from a channel, such as the channel 56. FIG. 5 also indicates how a bracket 66 fits into one of the slots 56 for supporting center rails 62 and wherein the bracket has a thickness or depth which corresponds generally to the distance between the bottom of the channel 56 and the bottom of slot 104 so as not to interfere with the side edge of a picket 58 disposed in the spacer members.

Referring now to FIG. 6, there is shown a portion of one of the tongue and groove pickets 58. The picket 58 includes opposed longitudinal sidewalls 140 and 142 and transverse end walls 144 and 146 which are intersected, respectively, by a longitudinal projecting tongue portion 59 and the opposed longitudinal groove 60. The picket 58, like a majority of the other components of the fence assemblies 10 and 50, may be formed of extruded polyvinyl chloride or a similar plastic material.

Figure 7:
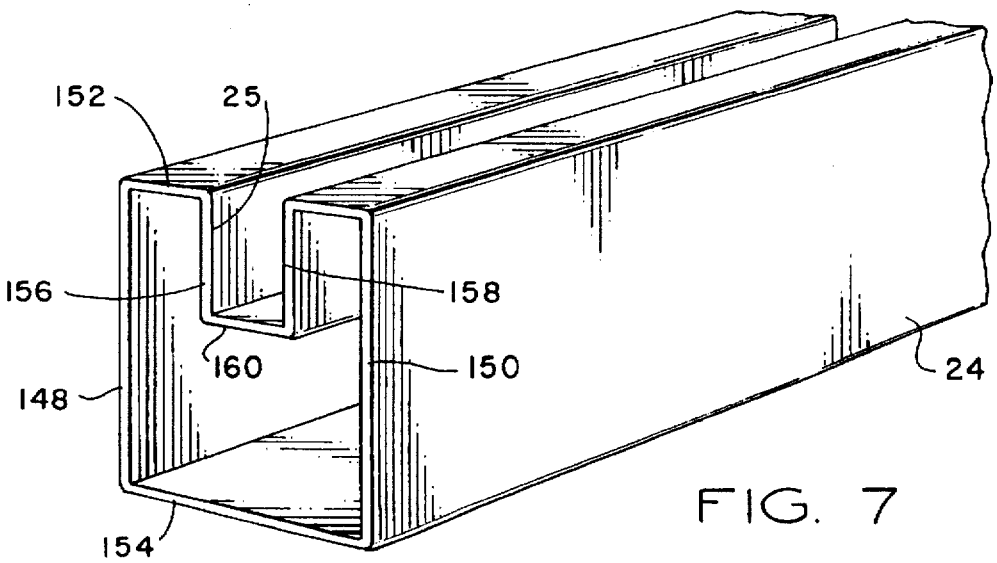
FIG. 7 is a perspective view of a portion of the top or bottom rail of the fence assembly of the present invention.

Referring now to FIG. 7, further details of one of the top and bottom rails is illustrated. The bottom rail 24 is illustrated by way of example and is characterized by a generally rectangular cross section shaped member having opposed side walls 148 and 150, and opposed end walls 152 and 154. The end wall 152 is intersected by the elongated slot 25 which is defined by parallel side walls 156 and 158 and a transverse bottom wall 160. The width of the slot 25 between the side walls 156 and 158 is slightly greater than the thickness of the picket 58, for example, as defined by its longitudinal side walls 140 and 142. For example if the pickets 58 have a thickness of about 0.5 inches the spacing between the sidewalls 156 and 158 may be approximately 0.54 inches and the depth of the slot 25 between the walls 152 and 160 may be on the order of 0.75 inches. The thickness of the walls defining the picket 58 and the bottom rail 24 may, for example, be on the order of 0.06 to 0.08 inches.

Figure 8:
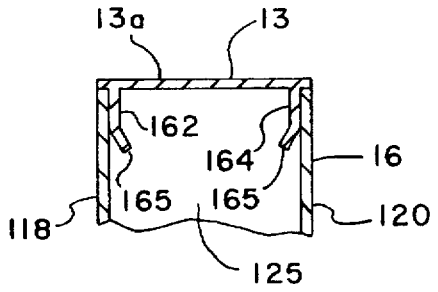
FIG. 8 is a detail section view showing the connection between a post and an end cap therefor.

Referring briefly to FIG. 8, a post end cap 13 is shown disposed over and covering the upper end of a post 16. The end cap 13 is preferably provided with opposed, depending leg portions 162 and 164 which have reentrant distal edges 165 formed thereon to facilitate forcibly inserting the leg portions 162 and 164 into the interior of the post 16 between its opposed sidewalls and 118 and 120. The spacing between the leg portions 162 and 164 may be slightly greater than the distance between the inside facing surfaces of the sidewalls 118 and 120 to provide a force fit of the end cap onto the upper end of the post 16. The end cap 15 is similarly configured.

As previously mentioned, the fence assemblies 10 and 15 may be erected using conventional fence construction techniques. The rigidity of the posts 12, 14 and 16, the rails 22 and 24, and the pickets 30 and 58 may be increased by filling the interior spaces of these elements with styrene or urethane foam plastic materials, for example. FIG. 4 shows the post 14 including a solid core of plastic foam material 170 disposed in space 113. Moreover, if a post, such as the post 12 or 14, is to be used as a gate post, its strength and stiffness may be enhanced by filling the interior spaces thereof with a concrete or mortar mix after setting the post in place during erection of the fence assembly. The post end caps 13 and 15 may be more firmly secured to the respective posts by using a suitable adhesive around the transverse edges of the posts.

Erection of the fence assembly 10 may be carried out by, for example, placing the posts 12, 14 and 16, and so on, in their predetermined locations and anchored in the concrete filled post holes, for example. The spacers 40 and 42, for example, are then cut to their appropriate lengths and snapped into the channels in their respective posts 14 and 16, for example, as shown. The bottom rails 24 may then be positioned between the posts by sliding the ends of the rails through the channels formed in the respective posts until they are in position resting on and above the spacer members 40 and 42. Additional spacer members such as the members 44 and 46 may then be cut to length, if not already provided in predetermined lengths, and snapped into the channels in the posts for receipt of the pickets 28. The pickets 28 may then be installed in the slots formed in the spacer members, the slot 25 formed in the bottom rail 24 and positioned as desired. If the pickets 28 are used in the fence assembly 10 they may be positioned abutting each other or spaced apart to provide gaps between adjacent pickets of any desired width. After installation of the pickets, the top rail 22 may be installed by placing the opposed ends of the rail in the respective channels in the adjacent posts and by snapping the rail into registration with the top edges of the pickets 28 disposed in the slots 23, for example. Lastly, the caps 13 and 15 may be installed to the top ends of the posts.

A fence assembly 50 may be similarly erected but, in addition to the steps taken to erect the fence assembly 10, the spacer segments 52 and 54 are cut to length and are installed with the center rail bracket 66 interposed therebetween and disposed in the appropriate channels such as the channels 56 of the post 16. The center rails 62 and brackets 66 may also be installed as an assembly by sliding such assembly into the channels of adjacent posts. The pickets 58 may then be installed in a suitable manner similar to that described above for the pickets 28 and the top rail 22 installed above and in registration with the top edges of the pickets 58. The end caps 13 and 15 may then, of course, be installed as described above.

Those skilled in the art will appreciate from the foregoing description that the fence assemblies 10 and 50, as well as other fence assemblies which may be made up using the components described herein, are unique in that the components are designed for simplicity of manufacture and erection while providing for a durable, aesthetically pleasing and functional exterior fence, preferably useable for residential privacy fencing and for defining boundaries between parcels of land, for example. Although preferred embodiments of the invention have been described in detail herein those skilled in the art will also recognize that various substitutions and modifications may be made without departing from the scope and spirit of the invention as recited in the appended claims.

What is claimed is:

1. An exterior fence assembly for use in determining the boundaries of a parcel of land or for forming a residential privacy fence comprising:

a plurality of spaced apart, generally vertically extending post members, each of said post members being formed of an extrudable plastic and having a perimeter wall defining an interior space, an elongated channel formed in said perimeter wall and extending over at least a portion of the length of said post member;

a spacer member insertable in said channel, said spacer member being formed of extruded plastic and comprising spaced apart, generally parallel extending tines, wall means intermediate said tines and defining a slot for receiving a side edge of a fence picket, said wall means defining said channel and said tines of said spacer member including cooperating projection and recess means for releasably locking said spacer member in said channel;

plural, side by side, elongated generally horizontally extending intermediate rail means having respective opposed ends; and support bracket means disposable in said channel of each of adjacent ones of said post members, said support bracket means including opposed spaced apart slots for receiving respective ends of said intermediate rail means extending between adjacent ones of said post members, respectively.

2. The fence assembly set forth in claim 1 wherein:

said tines include opposed, outwardly facing projections formed thereon and said wall means defining said channel include opposed recesses, respectively, for receiving said projections on said tines.

3. The fence assembly set forth in claim 1 including:

an end cap engageable with a transverse end of said post members, respectively, for closing said interior space and for retaining at least one of said spacer member and said picket in said channel.

4. An exterior fence assembly for use in determining the boundaries of a parcel of land or forming a residential privacy fence, said fence assembly being formed entirely of parts formed of an extruded polymer selected from a group consisting of styrenic resins and vinyl based resins, said fence assembly including:

a plurality of spaced apart, generally vertically extendable posts, each of said posts being formed of extruded polymer and having a perimeter wall defined by opposed sidewalls and endwalls integrally joined together and an elongated channel formed in said perimeter wall and intersecting at least one of said sidewalls and endwalls and extending over at least a portion of the length of said posts, respectively, said sidewalls, said endwalls and said channel defining a hollow interior space filled with a reinforcing material;

an extruded polymer spacer member insertable in said channel of adjacent posts, respectively, and including an elongated slot formed therein including means cooperable with wall means defining a portion of said channel to retain said spacer member in said channel, respectively;

an elongated extruded polymer bottom rail member extending between adjacent ones of said posts and having opposed ends insertable in said channels in said posts in a predetermined position as determined by said spacer members;

an elongated extruded polymer top rail member extending between adjacent ones of said posts and having opposed ends insertable in said channels of said posts, respectively;

each of said rail members including an elongated slot formed therein; and a plurality of generally hollow, vertically extending extruded polymer pickets disposed side by side between said rail members and engaged therewith in said slots, in said rail members, respectively, each of said pickets being characterized by opposed endwalls and opposed parallel sidewalls, said sidewalls being spaced apart such as to permit insertion of opposite ends of said pickets in said slots in said rail members, respectively, and respective ones of said pickets adjacent said posts being insertable in said slots in said spacer members, respectively, to form said fence assembly.

5. The fence assembly set forth in claim 4 including:

a support bracket disposable in respective ones of said channels of adjacent posts, and elongated generally horizontally extending intermediate rail means extendable between at least adjacent ones of said posts and supported by said support brackets at their opposite ends, respectively.

6. The fence assembly set forth in claim 4 wherein:

said spacer member includes spaced apart generally parallel extending tines and wall means intermediate said tines and defining said slot;

said wall means defining said channel and said tines of said spacer member include cooperating projection and recess means disposed on one of said wall means and said tines for releasably locking said spacer member in said channel.

7. The fence assembly set forth in claim 6 wherein:

said tines include opposed outwardly facing elongated projections formed thereon and said wall means defining said channel include opposed recesses, respectively, for receiving said projections on said tines.

8. The fence assembly set forth in claim 7 wherein:

said tines include inwardly sloping edges adjacent said projections and engageable with said wall means defining said channel to provide for elastic deflection of said tines during insertion of said spacer member in said channel into locking engagement in said recesses.

9. The fence assembly set forth in claim 4 wherein: said reinforcing material comprises a foamed plastic.

* * * * *